United States Patent [19]

Owens

[11] 4,360,114

[45] Nov. 23, 1982

[54] LINERLESS BOTTLE CAP

[75] Inventor: Phillip J. Owens, Louisville, Ky.

[73] Assignee: Thoroughbred Plastics Corp., Louisville, Ky.

[21] Appl. No.: 321,976

[22] Filed: Nov. 16, 1981

[51] Int. Cl.[3] ..... B65D 53/00

[52] U.S. Cl. ..... 215/329; 215/344; 215/DIG. 1

[58] Field of Search ..... 215/344, DIG. 1, 329

[56] References Cited

U.S. PATENT DOCUMENTS

| | | | |
|---|---|---|---|
| 2,752,059 | 6/1956 | Schneider | 215/DIG. 1 |
| 3,053,406 | 9/1962 | Wandell | 215/344 X |
| 3,074,579 | 1/1963 | Miller | 215/DIG. 1 |
| 3,255,909 | 6/1966 | Miller et al. | 215/DIG. 1 |
| 3,568,871 | 3/1971 | Livingstone | 215/DIG. 1 |
| 3,815,771 | 6/1974 | Marks | 215/344 |
| 3,844,439 | 10/1974 | Demers et al. | 215/344 |

*Primary Examiner*—Donald F. Norton

*Attorney, Agent, or Firm*—Beveridge, DeGrandi & Kline

[57] ABSTRACT

A linerless bottle cap having a plurality of resilient concentric sealing rings for abutment with the annular rim about the incipient mouth of the neck of a bottle in sealing the mouth thereof, preferably two concentric sealing rings, the concentric sealing rings being preferably of scalene cross section having a curvilineal depending vertex comprising the sealing lip thereof and in which the outer face thereof extends from the top portion of the cap at an acute angle toward the inner diameter of the skirt thereof, the outermost of the concentric sealing rings being the longer and the others being stepped progressively shorter from the outermost to the innermost thereof, the concentric sealing rings being spaced apart for abutment of the confronting faces thereof on tightening of the cap on the bottle, the confronting faces of the concentric sealing rings having a common terminus adjacent joinder thereof to the top portion of the cap.

8 Claims, 4 Drawing Figures

LINERLESS BOTTLE CAP

BRIEF BACKGROUND, FIELD AND OBJECTIVES OF THE INVENTION

This invention relates to improvements in linerless bottle caps.

In the provision of caps for bottles intended to contain liquids, particularly alcoholic beverages, the cap usually includes a compressible sealing liner for abutment against the annular rim about the incipient mouth of the neck of the bottle to provide a tight seal despite imperfections in the surface of the annular rim.

I am aware that others have previously proposed use of various types of sealing protuberances as depending from the inner surface of the top of a bottle cap in place of the use of a compressible sealing liner. For instance, as shown in U.S. Pat. Nos. 2,886,198; 3,053,406; 3,074,579; 3,151,757; 3,215,297; 3,255,909; 3,232,470; 3,370,732; 3,844,439; and 4,122,965. As may be expected, such sealing protuberances are in the nature of a sealing ring or sealing rings, of various cross sectional configuration and arranged in various attitudes of extension from the top and/or the skirt of the bottle cap. Thus, as shown by these prior patents, criticality of sealing capability is a function of cross sectional configuration and attitude of the sealing rings of a linerless bottle cap.

Considering that, after being tightened onto a bottle, the linerless cap may not be removed for some time, during which it may be further stressed by top loading when in storage or in transit, it can also be appreciated that the degree and amount of flexure required of the sealing ring or rings should be such as to avoid compression by cold flow movement and to provide a bottle cap having reasonably consistent application and removal torque and, preferably, less application torque for re-sealing. Here again, the amount or degree of compression or flexure required of the bottle cap sealing ring or rings is a function of the cross sectional configuration and attitude of the sealing rings of a linerless bottle cap.

It is thus a primary object of this invention to provide a linerless bottle cap having a plurality of concentric sealing rings, the cross sectional configuration and attitude of the sealing rings thereof being such as to provide optimum sealing characteristics, minimal compression by cold flow movement and a degree of flexure facilitating consistent bottle cap application and removal torque and less application torque for re-sealing.

A further object is the provision of a linerless cap having concentric sealing rings spaced to coact with each other in providing a seal formed not only in relation to abutment of the sealing rings with the annular rim about the incipient mouth of the neck of a container, but also as a derivative of abutment of the sealing rings with each other.

Other objects and advantages of the invention will become apparent from the following detailed description, taken in connection with the accompanying drawing, and in which drawing:

DETAILED DESCRIPTION

Figure 1:
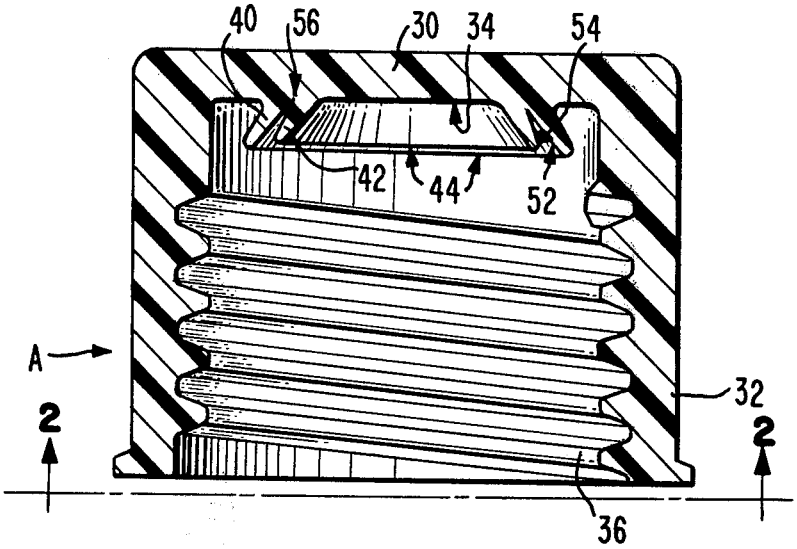
FIG. 1 is a vertical sectional view of my improved linerless cap.
Figure 2:
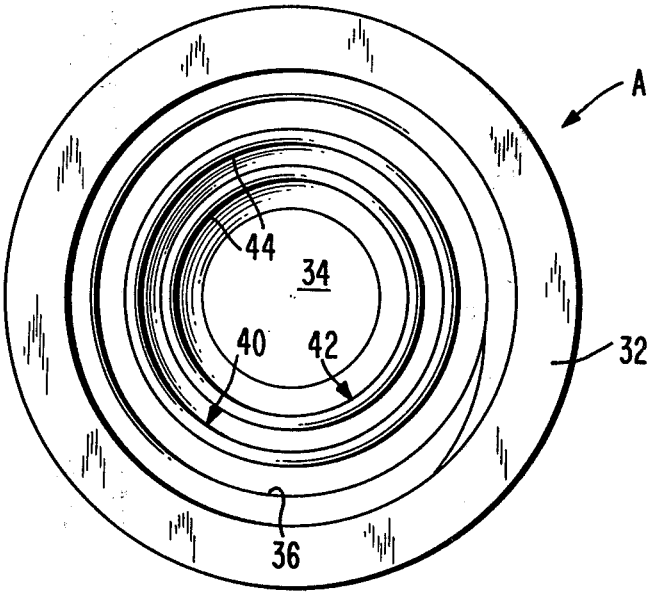
FIG. 2 is a bottom plan view as taken substantially on the line 2—2 of FIG. 1.

In the drawing, wherein similar reference characters designate corresponding parts throughout the several views, the letter A may generally designate my improved linerless cap as provided for attachment to a container B.

As shown, container B may comprise any conventional type of container including a neck 20 having an external constructed portion providing threads 22 about the periphery thereof and an annular rim 24 defining the incipient opening of the mouth 26 thereof.

Linerless cap A may have a body portion comprised of a top portion 30 and a depending skirt 32. As shown, top portion 30 may be of a disk-like configuration and skirt 32 may be of a tubular configuration perimetrically depending from top portion 30 and defining an inner surface 34 of top portion 30 which is confrontable to and across annular rim 24 of neck 20.

The inner diameter of tubular skirt 32 may be provided with retaining means, threads 36 in the form of invention as shown, for removable attachment of cap A to neck 20 of container B. Of course, if neck 20 of container B has an external constructed portion for snap fit of a cover or cap therefor, then the retaining means of my improved cap A will be appropriately configured for attachment of cap A thereto.

The sealing means of my improved linerless cap A preferably comprise a plurality of concentric sealing rings, an outer sealing ring 40 and an inner sealing ring 42 as herein shown. It is obvious that more than two concentric sealings may be provided if desired.

Sealing rings 40 and 42 are preferably of scalene cross section defining a sealing lip 44 at the depending vertex thereof and having an axis 46 of median depending attitude obliquely extending from inner surface 34 of top portion 30 at an acute angle toward the inner diameter of tubular skirt 32.

As is best shown in FIG. 1, sealing lip 44 of sealing ring 40 is preferably diametrically coplanar, as is sealing lip 44 of sealing ring 42, each being diametrically disposed for abutment with annular rim 24 of neck 20 and of substantially parallel diametric planarity to each other and to inner surface 34 of top portion 30.

Figure 3:
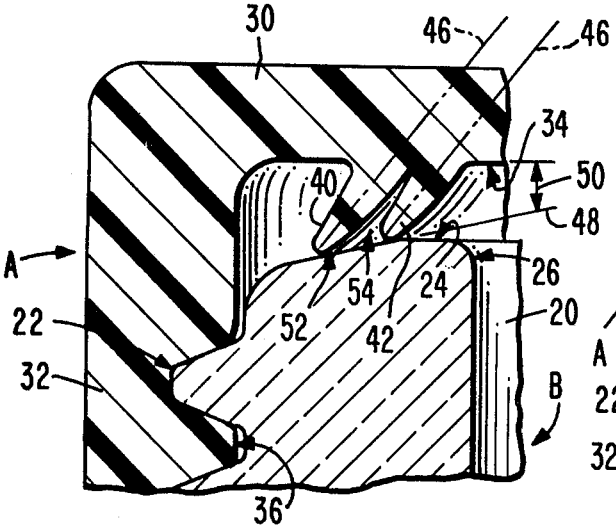
FIG. 3 is an enlarged fragmentary sectional view showing the interrelationship of the sealing rings of my improved linerless cap with the annular rim about the incipient mouth of the neck of a bottle upon initial contact of the sealing rings with such annular rim.

Sealing ring 40 is preferably of longer dependency from inner surface 34 of top portion 30 that is sealing ring 42, providing a stepped inclined plane generally conforming to the transverse plane of annular rim 24, as shown by plane line 48 in FIG. 3, so that sealing lip 44 of sealing ring 40 and sealing lip 44 of sealing ring 42 concurrently abut against annular rim 34 as cap A is tightened onto neck 20. Thus, sealing rings 40 and 42 are subjected to uniform compression and deflection as cap A is tightened onto neck 20.

As indicated at angle 50 of FIG. 3, the transverse plane of annular rim 34 of containers for alcholic beverages is substantially 20 degrees and, for use as a cap for containers of alcoholic beverages, the stepped inclined plane of sealing lips 44 is preferably at an angle of substantially 20 degrees with respect to the inner surface 34 of top portion 30.

For purposes as will be subsequently described, face 52 of sealing rim 40 which confronts face 54 of sealing ring 42 preferably have a common terminus 56 adjacent joinder thereof to top portion 30.

In the usual construction of linerless caps having concentric sealing rings, the same usually have independent interaction with the annular rim about the incipient mouth of the neck of the container, for instance as shown in U.S. Pat. Nos. 2,886,198; 3,053,406; 3,074,579; 3,215,297; and 3,844,439, or are forced apart, for instance, as shown in U.S. Pat. Nos. 3,151,757; 3,232,470; and 3,370,732.

Figure 4:
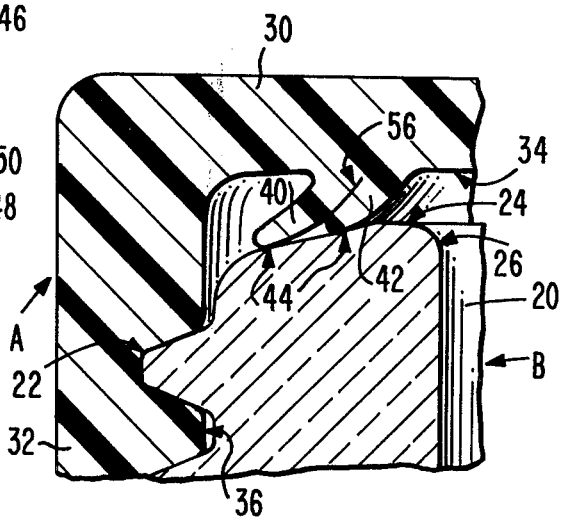
FIG. 4 is an enlarged fragmentary sectional view similar to FIG. 3 and showing my improved linerless cap in full sealing position on the bottle neck.

In contradistinction to such usual linerless cap construction, sealing rings 40 and 42 are preferably spaced apart for compressive deflection thereof in relation to common terminus 56 of confronting faces 52 and 54 so that, as shown in FIG. 4, confronting faces 52 and 54 abut against each other on tightening of cap A onto neck 20. Thus the strength and sealing capacity of each sealing ring 40 and 42 complements that of the other.

Various changes may be made to the form of the invention as herein shown and described without departing from the spirit of the invention or the scope of the following claims:

I claim:

1. A linerless cap for a container including a tubular neck having an external constructed portion for removable attachment of a cap thereto and terminating in an annular rim about the incipient opening of the mouth thereof, said linerless cap including a disk-like top portion having a tubular skirt perimetrically depending therefrom and defining an inner surface thereof confrontable to and across the annular rim of the neck of the container, said tubular skirt including retaining means cooperatively engageable with the external constructed portion of the neck of the container for removable attachment of said cap to the neck of the container, said top portion including a plurality of resilient concentric sealing rings depending from said inner surface of said top portion, each of said concentric sealing rings being of scalene cross section defining a sealing lip at the depending vertex thereof and having an axis of median depending attitude obliquely extending from said top portion to said sealing lip at an acute angle toward the inner diameter of said tubular skirt, said sealing lip of each said concentric sealing rings being substantially diametrically coplanar and diametrically disposed for abutment with the annular rim of the neck of the container and of a substantially parallel diametric planarity to each other and to the inner surface of said top portion, the substantially diametrical coplanarity of said sealing lip of the outermost of said concentric sealing rings being spaced farther apart from said inner surface of said top portion than the substantially diametrical coplanarity of the other of said concentric sealing rings and said sealing lip of each successive of said concentric sealing rings being spaced closer to said inner surface of said top portion than said sealing lip of the one of said concentric sealing rings next outwardly adjacent thereto.

2. A linerless cap as specified in claim 1 and wherein said concentric sealing rings comprise an outer and an inner sealing ring.

3. A linerless cap for a container including a neck having external threads for attachment of a cap thereto and terminating in an annular rim about the incipient mouth thereof, said linerless cap comprising a top portion having an inner surface confrontable to and across the annular rim of the neck of the container and including a skirt having an inner diameter provided with threads cooperatively engageable with the external threads of the neck for attachment of said cap to the neck of the container, said top portion including a plurality of resilient concentric sealing rings of substantially scalene cross section having an outer face obliquely depending from said inner surface of said top portion at an acute angle toward said inner diameter of said skirt and having a curvilineal truncated apex comprising the sealing lip thereof, said sealing lip of each said concentric sealing rings being substantially diametrically coplanar and diametrically disposed for abutment with the annular rim of the neck of the container and of a substantially parallel diametric planarity to each other and to said inner surface of said top portion, the diametric plane of said sealing lip of the outermost of said concentric sealing rings being spaced farther apart from the inner surface of said top portion than said sealing lip of any of the other of said concentric sealing rings and the diametric plane of said sealing lip of each successive of said concentric sealing rings being closer to said inner surface of said top portion than the diametric plane of said sealing lip of the one of said concentric sealing rings next outwardly adjacent thereto.

4. A linerless cap as specified in claim 3 and wherein said concentric sealing rings comprise an outer and an inner sealing ring.

5. A linerless cap as specified in either of claims 1, 2, 3, or 4 and wherein said concentric sealing rings are spaced apart in juxtaposition for compressive deflection thereof so that the confronting faces thereof abut against each other on tightening of said cap onto the neck of the container.

6. A linerless cap as specified in claim 5 and wherein the confronting faces of said concentric sealing rings have a common terminus adjacent to joinder thereof to said top portion.

7. A linerless cap as specified in claim 5 wherein said sealing lip of said concentric sealing rings from the outermost to the innermost thereof are stepped closer to said inner surface of said top portion along a plane which substantially conforms to the transverse plane of the annular rim about the incipient opening of the mouth of the neck of the container to which said linerless cap is to be attached.

8. A linerless cap as specified in claim 7 wherein the plane along which said sealing lip of said concentric sealing rings are stepped outwardly diverges at an angle of substantially twenty degrees from said inner surface of said top portion.

* * * * *